US005459558A

United States Patent [19]

Ishiyama

[11] Patent Number: 5,459,558

[45] Date of Patent: Oct. 17, 1995

[54] CHARGING DEVICE, IMAGE FORMING APPARATUS WITH SAME AND A PROCESS UNIT DETACHABLY MOUNTABLE TO THE IMAGE FORMING APPARATUS

[75] Inventor: Tatsunori Ishiyama, Yokohama, Japan

[73] Assignee: Canon Kabushiki Kaisha, Tokyo, Japan

[21] Appl. No.: 384,688

[22] Filed: Feb. 6, 1995

Related U.S. Application Data

[63] Continuation of Ser. No. 55,754, May 3, 1993, abandoned, which is a continuation of Ser. No. 703,864, May 21, 1991, abandoned.

[30] Foreign Application Priority Data

May 21, 1990 [JP] Japan ..... 2-130598

[51] Int. Cl.[6] ..... G03G 15/02

[52] U.S. Cl. ..... 355/219; 361/225

[58] Field of Search ..... 355/219, 220, 355/271, 277, 279, 274; 361/220, 221, 222, 223, 224, 225, 212

[56] References Cited

U.S. PATENT DOCUMENTS

| | | | |
|---|---|---|---|
| 4,309,737 | 1/1982 | Tolmie, Jr. | 361/225 |
| 4,959,688 | 9/1990 | Koitabashi | 355/219 |
| 5,006,902 | 4/1991 | Araya | 355/271 |
| 5,008,706 | 4/1991 | Ohmori et al. | 355/219 |
| 5,055,879 | 10/1991 | Bhagat | 355/219 |
| 5,126,913 | 6/1992 | Araya et al. | 361/225 |

FOREIGN PATENT DOCUMENTS

| | | | |
|---|---|---|---|
| 0130452 | 1/1985 | European Pat. Off. . | |
| 0308185 | 3/1989 | European Pat. Off. . | |
| 56-104351 | 8/1981 | Japan . | |
| 57-178267 | 11/1982 | Japan . | |
| 58-40566 | 3/1983 | Japan . | |
| 58-144844 | 8/1983 | Japan . | |
| 58-139156 | 8/1983 | Japan . | |
| 58-150975 | 9/1983 | Japan . | |
| 58-150975 | 9/1983 | Japan . | |
| 62-95571 | 5/1987 | Japan | 355/285 |
| 63-208877 | 8/1988 | Japan . | |
| 1185579 | 7/1989 | Japan | 355/285 |
| 224685 | 1/1990 | Japan . | |

*Primary Examiner*—A. T. Grimley
*Assistant Examiner*—Thu Dang
*Attorney, Agent, or Firm*—Fitzpatrick, Cella, Harper & Scinto

[57] ABSTRACT

A charging apparatus having a charging member contactable to a member to be charged, a pressing device for pressing the charging member onto the member to be charged at a pressing position. In the apparatus, an outside size of the charging member is larger away from the pressing position when the charging member is not pressed to the member to be charged.

30 Claims, 4 Drawing Sheets

CHARGING DEVICE, IMAGE FORMING APPARATUS WITH SAME AND A PROCESS UNIT DETACHABLY MOUNTABLE TO THE IMAGE FORMING APPARATUS

This application is a continuation of prior application Ser. No. 08/055/754 filed on May 3, 1993, which is a continuation of application Ser. No. 07/703,864 filed on May 21, 1991, both now abandoned.

FIELD OF THE INVENTION AND RELATED ART

The present invention relates to a contact type charging device to be contacted to the member to be charged (or discharged) to charge or discharge it, and an image forming apparatus with the same and a process unit detachably mountable to the image forming apparatus.

In an image forming apparatus such as an electrophotographic apparatus (copying machine or laser beam printer or the like) or an electrostatic recording apparatus, a corona discharger or charger is widely used as a means for charging an image bearing member (the member to be charged) such as a photosensitive member or a dielectric member.

The corona discharger is effective to uniformly charging the member to be charged such as the image bearing member to a predetermined uniform potential. However it involves the problems that it requires a high voltage source, that it has a lower charging efficiency, that the structure is bulky and complicated with the result of high cost, that the corona discharge produces a relatively large amount of undesirable ozone, and that the charging wire is contaminated or broken, or the like.

A contact type charging means having a charging member contacted to the member to be charged to charge the surface to be charged is recently noted, because of its advantages that the voltage of the required source is low, that the structure is simple, that it does not involve the break of a wire, and that the amount of produced ozone is very small. It is particularly noted as a means replacing the corona discharger for charging the member to be charged such as the photosensitive member, the dielectric member or another image bearing member in an image forming apparatus. The device is being developed, as disclosed in Japanese Laid-Open Patent Applications Nos. 178267/1982, 104351/1981, 40566/1983, 139156/1983 and 150975/1983, for example.

FIGS. 5A and 5B show a contact type charging apparatus using a rotatable roller (charging roller) as the charging member. FIG. 5A is a side view thereof, and FIG. 5B is a partly sectional front view.

Reference numerals 101 designates the member to be charged in the form of, for example, a rotatable photosensitive drum, which will hereinafter be simply called a photosensitive drum, in an electrophotographic apparatus. The photosensitive drum is rotated in the direction of the arrow (clockwise direction) at a predetermined process speed (peripheral speed).

Reference numeral 102 designates a charging roller and comprises a base member in the form of a conductive core metal 102*a*, an elastic layer 102*b* of conductive rubber having a low volume resistivity, formed integrally on the outer periphery of the core metal 102*a*, and a high resistance surface layer (high resistance layer) 102*c* at the outer surface of the roller. The base member is coated with the elastic layer 102*b* and the surface layer 102*c*. The opposite end portions of the core metal 102*a* are rotatably supported by conductive bearings 103. The roller is disposed in parallel with the photosensitive drum and is contacted thereto. The bearings 103 can be urged to the photosensitive drum by conductive pressing springs 104, by which the charging roller 102 is press-contacted to the photosensitive drum 101 with a predetermined pressure.

Reference numeral 105 designates a power source for applying a bias voltage to the charging roller 102. By the voltage source 105, the charging roller 102 is supplied through the conductive pressing springs 104, the conductive bearings 103 and the conductive core metal 102*a* with a DC voltage $V_{DC}$ of 1–2 KV, for example, or with a DC biased AC voltage $V_{AC}$ ($V_{DC}$+$V_{AC}$).

Thus, the peripheral of the photosensitive drum 101 rotated is charged to a predetermined polarity through the contact charging process.

Reference A designates an effective charging width (300 mm approximately, for example).

The contact type charging device using the charging roller 102 as the charging member, described above, involves the following problems.

The charging roller 102 is press-contacted to the surface of the photosensitive drum (the member to be charged) by being pressed (F, F) at the opposite ends or pressing positions for the core metal 102*a* of the roller. Therefore, the contact nip N between the charging roller 102 and the photosensitive drum 101, as shown in FIG. 5C, is more or less non-uniform in the longitudinal direction. More particularly, the width of the nip is large adjacent the opposite ends which are closer to the respective pressing positions, and is small in the middle portion away from the pressing positions. Adjacent the opposite ends, the charging is stabilized, but improper charging easily occurs in the middle part.

If an attempt is made to provide sufficient nip width in the middle portion by increasing the pressing forces F and F, then the nip widths adjacent the opposite end portions are too large, for example, 2–4 times the nip width in the middle portion.

Then, the charging roller 102 and the photosensitive drum 101 are more worn at the opposite end portions. With long term use, the photosensitive layer is scraped adjacent the end portions with the resulting liability of leakage of current.

In addition, if the pressing forces F and F are too large, the charging roller having the multilayer structure is liable to be peeled between the layers during the contact with the photosensitive drum 101.

When an oscillating voltage (the voltage periodically changes with time) such as a DC biased AC voltage is applied to the roller 102, the charging roller 102 vibrates corresponding to the frequency of the oscillating voltage. The toner unintentionally passed through the cleaning device for the photosensitive drum is caked on the surface of the photosensitive drum 101 by the surface of the charging roller 102 by the fine vibration of the charging roller 102. If this occurs, the toner may be fused on the surface of the photosensitive drum 101 under high temperature and high humidity ambient condition (H/H condition, for example, 32.5° C. and 85% RH). The toner fused portion results in improper charging with the result of improper image formation. As described, when the pressing forces are large, the friction between the charging roller 102 and the photosensitive drum 101 increases, so that the toner fusing is particularly remarkable adjacent the opposite end portions of the charging roller.

In order prevent the toner fusing under the H/H condition, it would be considered to lower the pressing forces F and F adjacent the opposite ends of the charging roller 102. If this is done, the charging roller which is straight without pressure results in the small nip width in the middle.

If the roller is not straight due to the unavoidable tolerance during the manufacturing (that is, it is slightly curved), the charging roller surface will be separated from the surface of the photosensitive drum in the middle portion in a part of the rotation. Then, the charging becomes impossible with the result of an improper output image.

It is difficult to provide proper roller pressure both at the opposite end portions and the middle portion of the charging roller because of the problem of toner fusing.

The above discussed problems apply to the structure shown in FIGS. 6A and 6B, wherein the use is made to a member 102A in the form of non-rotatable rod or an elongated pad as the charging member, and the opposite end portions of the core metal 102*a* are pressed and urged to the photosensitive drum 101 (the member to be charged) by the pressing springs 104, so that the charging member is press-contacted to the surface of the photosensitive drum 102 with a predetermined pressure.

SUMMARY OF THE INVENTION

Accordingly, it is a principal object of the present invention to provide a charging apparatus, a process unit and an image forming apparatus wherein the member to be charged, such as an image bearing member is uniformly charged in the detection of a generating line thereof.

It is another object of the present invention to provide a charging apparatus, a process unit and an image forming apparatus wherein the member to be charged such as an image bearing member and the charging member are properly pressed to each other, so that the wearing of the member to be charged and the charging member is reduced.

It is a further object of the present invention to provide a process unit and an image forming apparatus wherein the toner fusing onto the image bearing member by the charging member is prevented.

It is a further object of the present invention to provide a charging apparatus, a process unit and an image forming apparatus wherein when the member to be charged and the charging member are pressed to each other, the width and the press-contact force of the nip formed therebetween is substantially uniform irrespective of the distance from the position or positions at which they are pressed.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
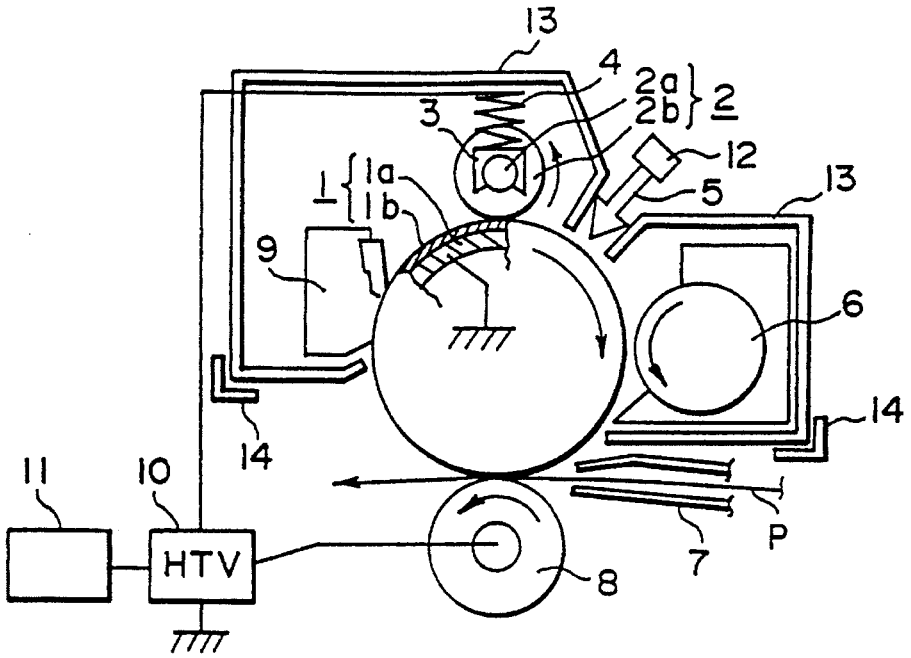
FIG. 1 shows an example of an image forming apparatus using a contact type charging apparatus according to an embodiment of the present invention.

FIG. 1 shows an example of an image forming apparatus wherein the charging apparatus of a contact type according to an embodiment of the present invention is used as a primary charger for charging the image bearing member in the form of a photosensitive drum. The image forming apparatus of this embodiment is in the form of a laser beam printer using an image transfer type electrophotographic process.

The photosensitive drum I comprises a drum base 1*a* of a grounded conductive material such as aluminum or the like and an organic photoconductor layer (OPC) thereon. They constitute a photosensitive layer 1*b* having a thickness of approximately 20 microns, for example. It has an outside diameter of 30 mm. It is rotatable in the clockwise direction at a predetermined process speed (peripheral speed), for example 23 mm/sec. The photosensitive layer may be of selenium, amorphous silicone, ZnO or the like.

A charging roller 2 is the contactable charging roller. It comprises a conductive core metal 2*a* made of iron or the like (base member) and a conductive rubber roller portion 2*b* thereon. It is of EPDM or the like.

To the core metal 2*a* of the charging roller, an oscillatory voltage is applied which is in the form of a negative-DC-voltage biased AC voltage by the voltage source 10, so that the surface of the rotating photosensitive drum 1 is charged to the negative polarity by the charging roller 2. The thus charged surface of the photosensitive drum 1 is exposed to laser beam 5 which is image-modulated at a constant printing density D (dpi) in accordance with time series digital electric picture element signals indicative of image information. Then, the potential of the exposed part is attenuated by the laser beam 5, so that an electrostatic latent image is formed on the surface of the photosensitive drum 1. A negatively charged toner is supplied from a developing sleeve 4 to the latent image surface by a developing device 6, so that the latent image is reverse-developed.

On the other hand, from an unshown speed supplying station, a transfer material P is supplied through a guide 7 to the nip (transfer position) between the photosensitive drum 1 and the transfer roller 8 as the transfer member in timed relation with the toner image on the photosensitive drum 1. The toner image is sequentially transferred from the surface of the photosensitive drum 1 to the surface of the transfer material P by the transfer bias having the polarity opposite from the polarity of the charge of the toner and supplied from the voltage source 10 to the transfer roller 8.

The transfer material P having passed through the transfer position is separated from the surface of the photosensitive drum I and is introduced into an unshown image fixing means, where it is subjected to the image fixing operation. It is discharged as a copy (print).

After the transferring and separating operation, the surface of the photosensitive drum 1 is cleaned by the cleaning device 9, so that the residual toner or another contamination is removed therefrom, so that it is prepared for the repeated image forming operation.

A controller in the form of a CPU 11 controls the potential and the timing of the voltage applied to the charging roller 2 and the transfer roller 8 from the bias application source 10.

In this embodiment, the charging roller 2, the developing device 6, the cleaning device 9 and the photosensitive drum I (image bearing member) are supported in a process unit 13, which is detachably mountable to the image forming apparatus in the form of a laser beam printer. During the mounting or dismounting operation of the process unit, the process unit 13 is slid along the guide 14 in the direction perpendicular to the sheet of the drawing of FIG. 1. The process unit 13 is not required to have all of such means but may be provided with only the charging roller 4 and the photosensitive drum 1.

Figure 2A:
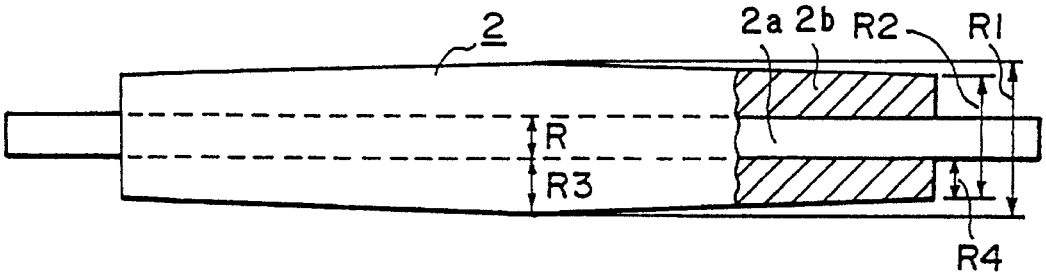
FIG. 2A is a partly cross-sectional front view of the charging apparatus when the charging roller thereof is not pressed.

The charging apparatus having the charging roller 2 will be described in detail. The core metal 2*a* of the charging roller 2 is of metal rod having a diameter of 5 mm, and the conductive roller portion 2*b*, as shown in FIG. 2, has an outer diameter R1 of 12.36 mm adjacent the longitudinal center of the roller 2, and an outside diameter R2 at the longitudinal end portions, of 12 mm. Thus, the diameters satisfy R1>R2, that is, the roller is crowned. With the crowned shape, the outer diameter of the roller gradually decreases toward each of the opposite longitudinal ends.

Thus, the surface of the charging roller 2 contactable to the photosensitive drum 1 has a compression elasticity.

Figure 2B:
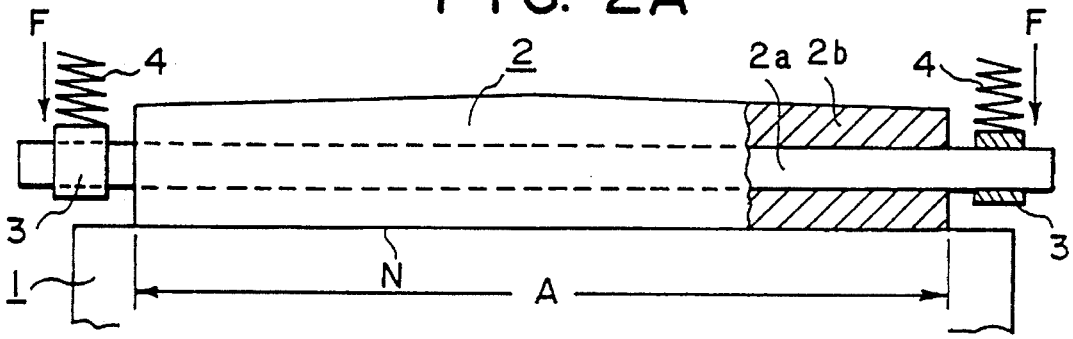
FIG. 2B shows the same but when the charging roller is press-contacted to the photosensitive drum.
Figure 2C:
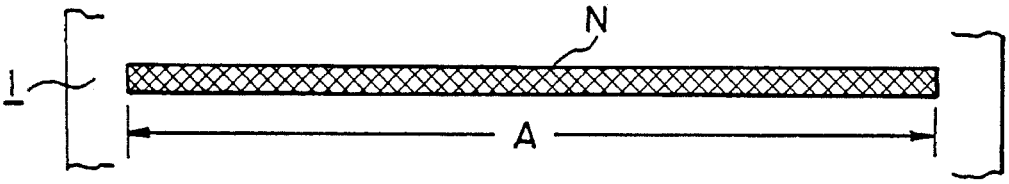
FIG. 2C illustrates the nip.

The crown shape of the charging roller 2 is required to be provided in the effective charging width A in FIG. 2B for the photosensitive drum 1.

The charging roller is contacted to the surface of the photosensitive drum in parallel with the generating line of the photosensitive drum 1 by rotatably supporting it at the longitudinal ends by the conductive bearing 3. The bearings 3 of the roller are urged toward the photosensitive drum by the conductive pressing spring 4 at a predetermined pressure. The bearing supports the core metal 1*a*. In this embodiment, the spring constant of the spring 4 is 0.08 kg/mm at each side. The pressing force provides the total pressure of 1 kg (500 g at each side). If the total pressure exceeds 1.5 kg, the wearing of the roller 2 and the drum I becomes intolerable, and therefore, it is preferably not more than 1.5 kg. The charging roller 2 rotates following the photosensitive drum 1 in this embodiment.

The charging roller 2 is supplied with a predetermined bias voltage from the bias voltage source 10 through the conductive pressing spring 4 and the conductive core metal 2*a*, so that the surface of the photosensitive drum I being rotated is charged to the predetermined potential of the predetermined polarity. In this embodiment, the polarity is negative. The charging roller 2 is supplied by the bias voltage source 10 with an oscillating voltage which is a combination of a DC voltage of −600 V and a sine AC voltage having a peak-to-peak voltage of 1400 Vpp–2000 Vpp. The peak-to-peak voltage is preferably not less than twice the charge starting voltage since otherwise spot like non-uniformity appears on the photosensitive drum 1. The charge starting voltage is defined in the following manner. A non-charged member to be charged is prepared, and the contact type charging member is contacted while being supplied with a DC voltage. The DC voltage is gradually increased, and the surface potential of the photosensitive drum (the member to be charged) is plotted relative to the DC voltage applied, with the increment of DC 100 V. The first plot is at the time when the surface potential appears on the member to be charged. A straight line is drawn by least square method. The DC voltage when the straight line crosses with the zero surface potential is defined as the charge starting voltage.

When the photosensitive drum has an organic photoconductor, the charge starting voltage was 560 V in this embodiment.

The charging roller 2 is crowned as described hereinbefore when it is not press-contacted to the photosensitive drum 1, the thickness of the conductive roller portion 2*b* (coating layer) increases away from the position where the pressing spring 4 press-contacts the coating layer 2*b* to the photosensitive drum 1. In other words, the thickness of the coating layer is larger in the middle portion than the longitudinal end portions of the charging roller 2. The roller 2 receives the forces at the longitudinal end portions, so that it is press-contacted to the photosensitive drum 1 surface against the compression elasticity. The nip N between the charging roller 2 and the photosensitive drum 1 is, therefore, substantially uniform in the nip width and the press-contact force along the length thereof.

Therefore, the charge is uniform in the longitudinal direction of the charging roller, and the wearing of the charging roller 2 and the photosensitive drum 1 adjacent the longitudinal end portions of the roller can be reduced. In addition, the leakage problem adjacent the end portions can be prevented.

The charging roller 2 is not subjected to local strong force during the rotation, and therefore, even if the oscillating voltage is applied to the charging roller, the toner is not fused on the photosensitive member even under the H/H condition. The crown shape is also effective to prevent the improper charging attributable to the small roller deformation, bending, depression or the like which otherwise easily occurs in the middle of the roller.

If the outer diameter R1 in the middle is larger than the end diameter R2 by not more than 5%, the nip width and the pressure is too large in the middle with the result of the tendency of toner fusing. If, on the other hand, the diameter R1 in the middle portion of the charging roller is larger than the end diameter R2 by less than 0.3%, the nip width and the pressure increase with the result of easy toner fusing at the end portions. In the middle of the charging roller having low pressing force (roller pressing pressure), the improper charging easily occurs.

Therefore, the outer diameter R1 is preferably larger than the outer diameter R2 by not less than 0.3% and less than 5%.

In order to prevent the toner fusing, (R1-R) is larger than (R2-R) by not less than 0.5% and less than 5%, where R is the outer diameter of the core metal 2*a*.

The thickness of the coating layer measured from the surface of the core metal 2*a* to the surface of the charging roller 2 is preferably such that the thickness R3 in the longitudinal middle portion is larger than that R4 at the opposite ends by not less than 0.5% and less than 3% from the standpoint of preventing the toner fusing.

In this embodiment, the photosensitive layer is of organic photoconductor. The toner is of styrene acryl toner having good charging property in the development and having good fixing property. However, when the organic photoconductive layer and styrene acrylic toner are used, the toner fusing is more remarkable than when the use is made with photosensitive layer such as an amorphous silicon or selenium and polyester toner. Therefore, when the organic photoconductive layer is used with the stryene acrylate toner, the crowned charging roller is particularly effective.

The charging roller 2 in this embodiment has a surface resistance layer 2*c* (N methoxymethyl nylon), and therefore, the coating layer for the core metal 2*a* is of a two layer structure.

The conductive rubber roller (lower layer) 2*b*, that is, the elastic layer of EPDM, the volume resistivity is as low as $10^3$–$10^5$ ohm.cm. The roller 2*b* reduces the pressure on the charging roller surface, and increases the width of the nip. From these standpoints, the hardness thereof is 30–75 degrees (Asker-C).

The surface resistance layer 2*c* has a thickness of 5–50 microns, for example, and has a larger volume resistivity than the rubber roller portion 2*b*. It is an intermediate resistance layer having a volume resistivity of $10^7$–$10^{10}$ ohm and controls the resistance of the entire charging roller, by which the current leakage which is possible when damages or pin holes exist in the photosensitive drum, is prevented. The two layer structure roller 2 is press-contacted to the photosensitive drum 1. Then, the lower layer 2*b* mainly deforms. Because of the two or more layer of the coating layer, the variation in the resistivity due to the pressure distribution attributable to the crown shape (particularly when conductive filler material is dispersed), can be reduced. The surface layer is not separated even when the two or more layer structure is used.

Figure 4A:
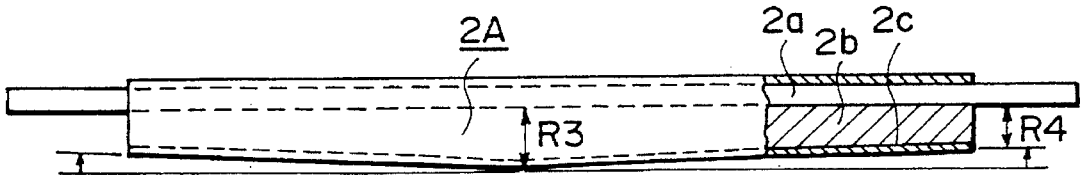
FIG. 4A is a partly sectional front view of a charging member in the form of a non-rotatable rod or an elongated pad, when the pressure is not applied thereto.

Referring to FIG. 4A, an additional embodiment of the present invention will be described, wherein the charging member is in the form of a non-rotatable rod or an elongated pad (2A). The opposite end portions of the core metal 2*a* are pressed to the photosensitive drum (the member to be charged) 1 by pressing springs 4, so as to press-contact such a charging member to the photosensitive drum 1.

Figure 4B:
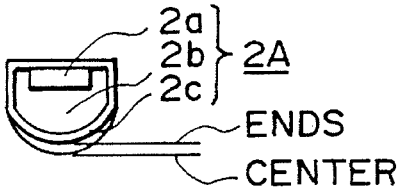
FIG. 4B is a side view thereof.
Figure 4C:
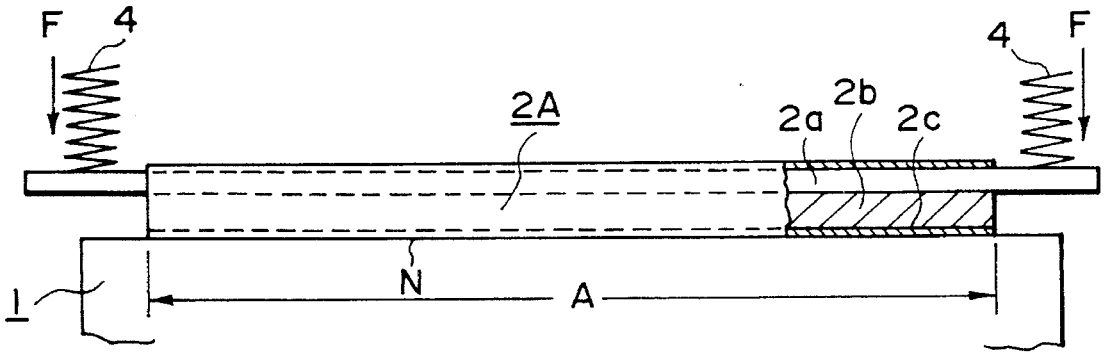
FIG. 4C is a partly sectional front view when it is press-contacted to the photosensitive drum.

FIG. 4A is a partly sectional front view when no pressure is applied to the charging member 2*a*. FIG. 4B is a side view thereof. FIG. 4C is a partly sectional front view of a part of the charging member press-contacted to the photosensitive drum 1.

Figure 3:
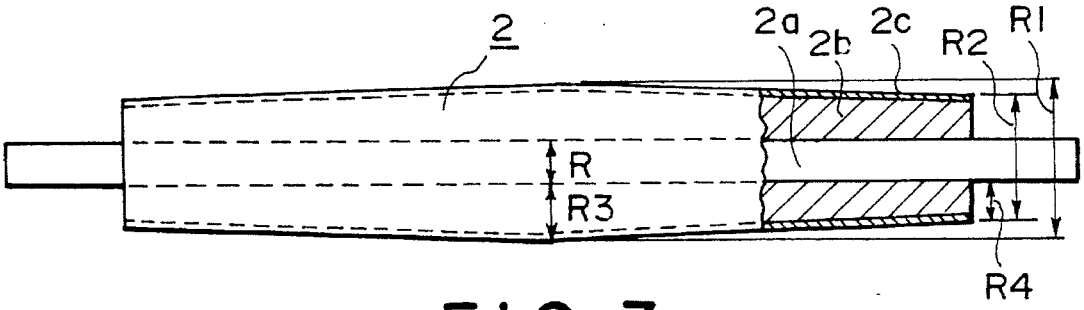
FIG. 3 is a partly cross-sectional view of a charging roller according to another embodiment of the present invention.

It comprises a conductive rubber layer 2*b*, a surface resistance layer 2*c*, which are made of the same materials as in FIG. 3 example.

The charging member 2*a* has a contact surface having a compression elasticity. As shown in FIG. 4A and 4B, when it is not press-contacted to the drum 1, the bottom side is inclined downwardly away from the longitudinal center, assuming that the drum is at the lower side thereof.

Figure 4D:
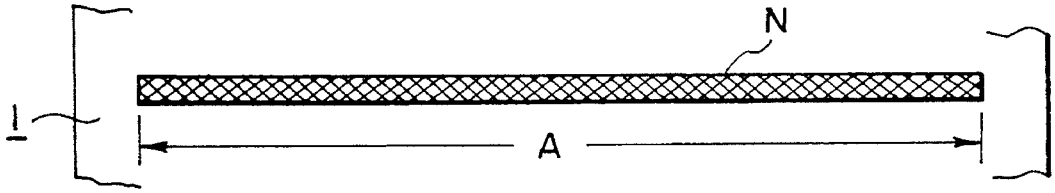
FIG. 4D illustrates the nip therebetween.
Figure 5A:
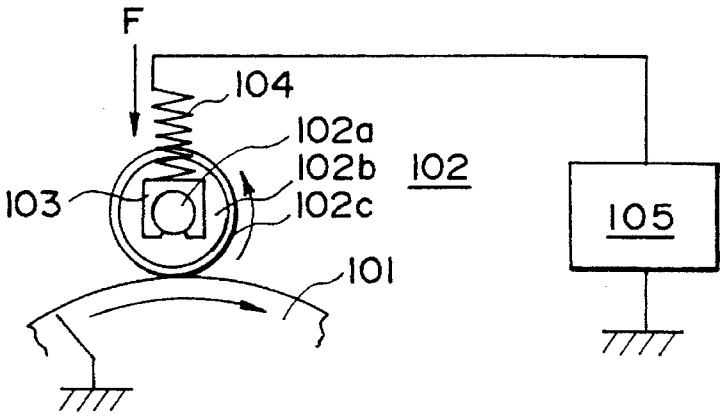
FIG. 5A is a side view of a conventional charging roller type charging apparatus.
Figure 5B:
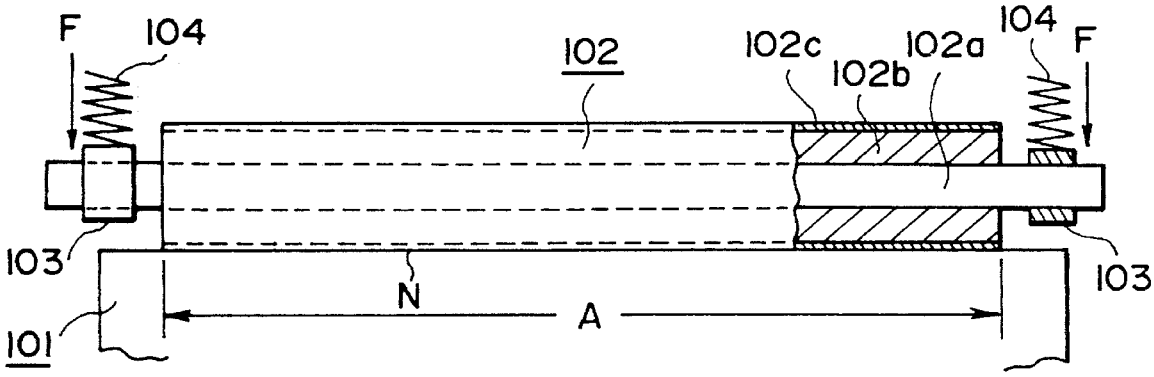
FIG. 5B is a partly sectional front view thereof.
Figure 5C:
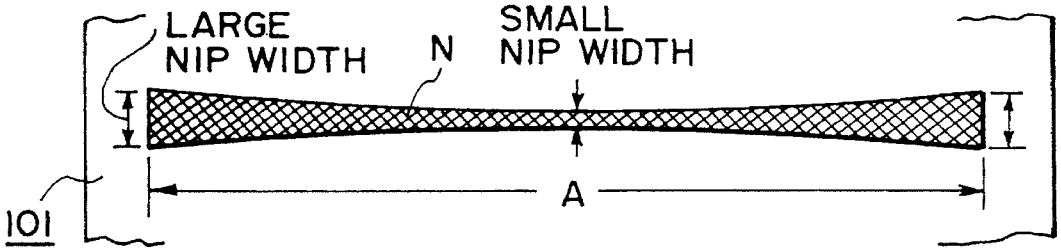
FIG. 5C illustrates the nip.
Figure 6A:
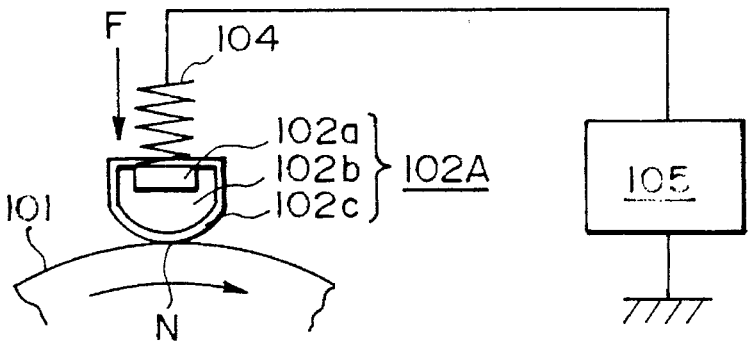
FIG. 6A is a side view of a charging apparatus having a charging member in the form of a non-rotatable rod or an elongated pad.
Figure 6B:
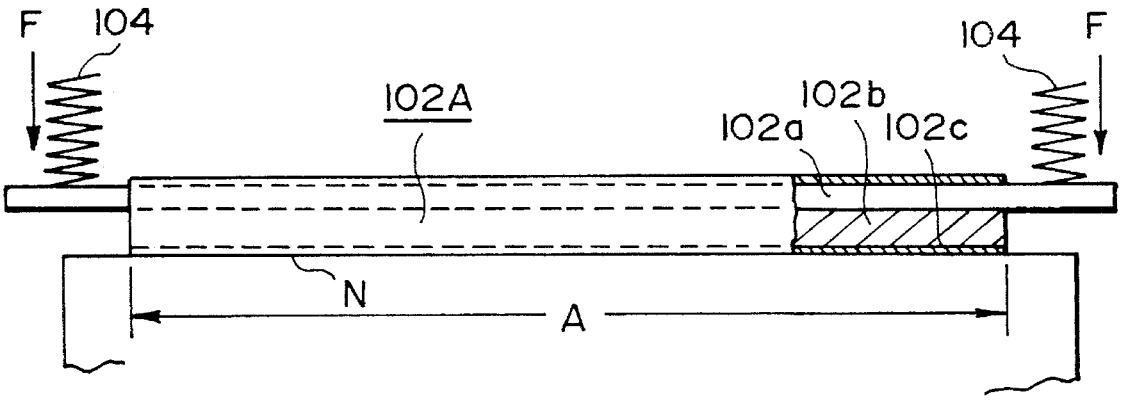
FIG. 6B is a partly sectional front view.

The charging member is press-contacted to the surface of the photosensitive drum against the compression elasticity at the longitudinally opposite ends by forces F. Therefore, as described in the foregoing, the nip N between the charging member 2*a* and the photosensitive drum 1 is made uniform along the length thereof, as shown in FIG. 4D, in the nip width and the contact pressure.

The charging member is usable for the charging roller 8, which is contacted to the backside of the transfer material P.

As described in the foregoing, according to the present invention, the thickness of the coating layer of the charging member is larger away from the pressure application point. Therefore, the degree of compression resulting from the pressure of the charging member to the member to be charged is larger away from the pressure application point, in other words, it is small toward the point. As a result, the nip width and the contact pressure are made uniform along the length thereof.

Therefore, the problem with the conventional structure that the nip width and the contact pressure reduces toward the central portion which is away from the point of pressure application, is avoided. The nip width and the contact pressure is generally uniform along the length.

The problem resulting from the increase of the pressure for providing sufficient nip width and the contact pressure, can be avoided.

Furthermore, the charging becomes uniform along the generating line direction of the member to be charged, and the local large wearing of the member to be charged and the charging member can be reduced. In addition, the toner fusing on the image bearing member can be prevented, so that good image formation is possible.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member for bearing a toner image;

a charging member for charging said image bearing member, said charging member being contactable to said image bearing member, and said charging member comprising a base member, a surface layer contacted to said image bearing member, and an elastic layer between said surface layer and said base member, wherein said surface layer has a volume resistivity higher than that of said elastic layer; and pressing means for pressing said charging member onto said image bearing member at a pressing position, wherein under a condition that said charging member is not pressed to said image bearing member, an outer diameter and a thickness of said elastic layer of the charging member increase away from the pressing position, while said surface layer has a constant thickness irrespective of a distance from the pressing position.

2. An apparatus according to claim 1, wherein the outside size is larger toward a longitudinal center of said charging member.

3. An apparatus according to claim 2, wherein the thickness of the elastic layer is larger toward a longitudinal center of the charging member.

4. An apparatus according to claim 1, wherein said charging member comprises a rotatable roller.

5. An apparatus according to claim 4, wherein said pressing means applies pressure at longitudinally opposite ends of said roller, and wherein an outer diameter of said roller increases toward a longitudinal center of the roller from each longitudinally opposite end thereof.

6. An apparatus according to claim 5, wherein an outer diameter R1 adjacent a longitudinal central portion of said roller is larger than an outer diamer R2 adjacent to longitudinally opposite ends by not less than 0.3% and less than 5%.

7. An apparatus according to either claim 1 or 5, wherein said elastic layer has a first thickness at a first position most remote from a second position where said pressing means applies pressure to said charging member and a second thickness at a position adjacent the second position, and said first thickness is larger than said second position by not less than 0.5% and less that 3%.

8. An apparatus according to claim 5, wherein (R1-R) is larger than (R2-R) by not less than 0.5% and less than 5% where R is an outer diameter of said base member, R1 is an outer diameter of said charging member adjacent to a longitudinally central portion thereof, and R2 is an outer diameter of said charging member adjacent a longitudinal end portion thereof.

9. An apparatus according to claim 1, wherein the toner image is formed with a styrene acrylic toner.

10. An apparatus according to claim 1, wherein said image bearing member has an organic photoconductive layer.

11. An apparatus according to claim 9, wherein said image bearing member has an organic photoconductive layer.

12. An apparatus according to claim 1, wherein an oscillating voltage is applied between said image bearing member and said charging member.

13. An apparatus according to claim 12, wherein said oscillating voltage has a peak-to-peak voltage which is not less than twice a charge starting voltage between said image bearing member and said charging member.

14. An apparatus according to claim 1, further comprising a process unit containing said image bearing member and said charging member, wherein said process unit is detachably mountable to said image forming apparatus.

15. A process unit detachably mountable to an image forming apparatus, said process unit comprising:

an image bearing member for bearing a toner image;

a charging member for charging said image bearing member, said charging member being contactable to said image bearing member, and said charging member comprising a base member, a surface layer contacted to said image bearing member, and an elastic layer between said surface layer and said base member, wherein said surface layer has a volume resistivity higher than that of said elastic layer; and pressing means for pressing said charging member onto said image bearing member at a pressing position, wherein under a condition that said charging member is not, pressed to said image bearing member, an outer diameter and a thickness of said elastic layer of said charging member increase away from the pressing position, while said surface layer has a constant thickness irrespective of a distance from the pressing position.

16. An apparatus according to claim 15, wherein a thickness of the elastic layer, when said charging member is not pressed onto said image bearing member, is larger away from said pressing means.

17. An apparatus according to claim 1, wherein an outside size of said charging member, at a position most away from the pressing position, is larger than an outside size of said charging member at a position adjacent the pressing position by not less than 0.3% and less than 5%.

18. An apparatus according to claim 16, wherein said pressing means presses said charging member at longitudinal end portions of said charging member, and the thickness of the elastic layer is larger toward the longitudinal center position of said charging member.

19. An apparatus according to claim 1, wherein said pressing means presses said charging member at longitudinal end portions of said charging member, and the thickness of said elastic layer is larger toward the longitudinal center position of said charging member.

20. An apparatus according to claim 1, wherein said charging member includes a stationary pad.

21. An apparatus according to claim 15, wherein the toner image is formed with a styrene acrylic toner.

22. An apparatus according to claim 15, wherein said image bearing member has an organic photoconductive layer.

23. An apparatus according to claim 21, wherein said image bearing member has an organic photoconductive layer.

24. An apparatus according to claim 15, wherein an oscillating voltage is applied between said image bearing member and said charging member.

25. An apparatus according to claim 25, wherein said oscillating voltage has a peak-to-peak voltage which is not less than twice a charge starting voltage between said image bearing member and said charging member.

26. A charging member for charging an image bearing member, said charging member being contactable to the image bearing member, said charging member comprising:

a base member;

a surface image layer contacted to said image bearing member; and an elastic layer between said surface layer and said base member, wherein the surface layer has a volume resistivity higher than that of said elastic layer, wherein an outside diameter and a thickness of said elastic layer of said charging member decrease away from a longitudinally central portion toward a longitudinal end portion, while said surface layer has a constant thickness irrespective of a distance from the pressing position.

27. A member according to claim 26, wherein said charging member comprises a rotatable roller.

28. A member according to claim 27, wherein an outer diameter R1 adjacent to the longitudinal central portion of the charging member is larger than an outer diameter R2 adjacent to longitudinally opposite ends of the charging member by not less than 0.3% and less than 5%.

29. A member according to claim 27, wherein the difference R1-R is larger than the difference R2-R by not less than 0.5% and less than 5% where R is an outer diameter of said base member, R1 is an outer diameter of said charging member adjacent to a longitudinally central portion thereof, and R2 is an outer diameter of said charging member adjacent to a longitudinal end portion thereof.

30. An apparatus according to claim 15, wherein said pressing means presses said charging member at a longitudinal end thereof, and the outside size of said charging member becomes larger from the longitudinal end to the longitudinal center of said charging member.

* * * * *

UNITED STATES PATENT AND TRADEMARK OFFICE

CERTIFICATE OF CORRECTION

PATENT NO. : 5,459,558

DATED : October 17, 1995

INVENTOR(S) : Tatsunori Ishiyama

It is certified that error appears in the above-indentified patent and that said Letters Patent is hereby corrected as shown below:

ITEM [56] ON THE COVER PAGE (FOREIGN PATENT DOCUMENTS):

"58-150975 9/1983 Japan" (second occurrence) should be deleted;
"1185579 7/1989 Japan"
224685 1/1990 Japan" should read --1-185579 7/1989 Japan
2-024685 1/1990 Japan--

COLUMN 4:

Line 31, "drum I" should read --drum 1--.

UNITED STATES PATENT AND TRADEMARK OFFICE

CERTIFICATE OF CORRECTION

PATENT NO. : 5,459,558 Page 2 of 2

DATED : October 17, 1995

INVENTOR(S) : Tatsunori Ishiyama

It is certified that error appears in the above-indentified patent and that said Letters Patent is hereby corrected as shown below:

COLUMN 5:

Line 5, "drum I" should read --drum 1--; and
Line 61, "drum I" should read --drum 1--.

COLUMN 9:

Line 47, "not," should read --not--.

COLUMN 10:

Line 23, "claim 25," should read --claim 24,--.

Signed and Sealed this

Second Day of April, 1996

Bruce Lehman

*Attest:*

BRUCE LEHMAN

*Attesting Officer*

*Commissioner of Patents and Trademarks*